US006299667B1

(12) United States Patent
Frohne

(10) Patent No.: US 6,299,667 B1
(45) Date of Patent: Oct. 9, 2001

(54) METHOD AND DEVICE FOR REMOVING DUST FROM AREAS WITH HIGH DUST LOADING

(75) Inventor: Klaus Frohne, Dresden (DE)

(73) Assignee: KF Strahltechnik Dresden, Dresden (DE)

( * ) Notice: Subject to any disclaimer, the term of this patent is extended or adjusted under 35 U.S.C. 154(b) by 0 days.

(21) Appl. No.: 09/467,159

(22) Filed: Dec. 20, 1999

(30) Foreign Application Priority Data

Dec. 19, 1998 (DE) ..... 198 58 883

(51) Int. Cl.[7] ..... B01D 50/00

(52) U.S. Cl. ..... 95/22; 55/337; 55/338; 55/342; 55/343; 55/344; 55/385.2; 55/DIG. 18; 95/268; 96/397; 96/421; 451/88

(58) Field of Search ..... 95/22, 268; 451/88, 451/89; 55/337, 315, 321, DIG. 18, 385.1, 385.2, 470, 468, 338, 340, 342, 343, 344; 96/400, 397, 417, 421

(56) References Cited

U.S. PATENT DOCUMENTS

| | | | | |
|---|---|---|---|---|
| 1,692,948 | * | 11/1928 | Moore | 451/88 |
| 2,696,910 | * | 12/1954 | Ljungdell et al. | 451/88 |
| 2,912,918 | * | 11/1959 | Mead | 55/385.2 |
| 2,935,820 | * | 5/1960 | Mead | 55/385.2 |
| 3,407,719 | * | 10/1968 | Temple et al. | 55/342 |
| 3,849,091 | * | 11/1974 | Peterson | 55/341 |
| 3,863,392 | * | 2/1975 | Haker | 451/88 |
| 4,723,378 | * | 2/1988 | Vankuiken, Jr. et al. | 451/88 |
| 4,787,179 | * | 11/1988 | Lewis | 451/88 |
| 5,556,324 | * | 9/1996 | Shank, Jr. | 451/88 |

FOREIGN PATENT DOCUMENTS

| | | | |
|---|---|---|---|
| 93 00 580 U1 | 1/1993 | (AT) | F24F/7/00 |
| 40 21 094 A1 | 1/1992 | (DE) | F24F/3/16 |
| 43 00 830 C2 | 7/1994 | (DE) | F24F/7/00 |
| 298 04 941 U1 | 3/1998 | (DE) | B08B/15/00 |

* cited by examiner

*Primary Examiner*—Duane S. Smith
(74) *Attorney, Agent, or Firm*—Darby & Darby

(57) ABSTRACT

A method and device for removing dust from spaces having a high dust loading utilizing a blast jet chamber having a cartridge filter (2) for the exhaust volume flow and a cyclone dust separator (4) as well and an associated exhaust stack (3) for the recirculating volume flow, wherein the blast jet chamber (1) further includes intake labyrinths (6), fresh air shutters (5), recirculating air channels for the recirculating volume flow, and blowers (9, 10) with a control device (8) for producing the volume flows.

12 Claims, 1 Drawing Sheet

METHOD AND DEVICE FOR REMOVING DUST FROM AREAS WITH HIGH DUST LOADING

BACKGROUND OF THE INVENTION

1. Field of the Invention

The present invention relates to a method and a device for removing dust from areas with high dust loading.

2. Description of the Related Art

Areas with high dust loading can be found, for example, in blast jet chambers. Government regulations do not permit dust produced by jet blasting of workpieces which consists, for example, of removed rust, scales, paint coverings or abrasives, to enter the environment in the produced concentration and create an environmental hazard. For this reason, the aerosols generated in the blast jet chambers are treated as spent air and drawn off. By employing suitable methods, the spent air is subsequently separated from the solid constituents and dust, respectively, and exhausted to the surroundings, containing only a small residual dust fraction. The air volume to be treated depends on the number of the air changes necessary for providing sufficient visibility in the jet chamber. Accordingly, the number of the air changes is very high in comparison with the number of air changes required for controlling the air quality in conventional office and work areas.

Importantly, the pressure in blast jet chambers should always be slightly lower than the ambient pressure to prevent dust from uncontrollably escaping into the surroundings through leaks in the chamber. The slightly lower pressure guarantees that an air currents eaters the chamber from the outside at all times.

Air filters in the form of, for example, cartridge filters are suitable to separate the air and the dust particles and to attain a small residual dust fraction of approximately 1 mg/m$^3$. The cartridge filters have the characteristic feature that the pressure drop increases with increasing filtration efficiency.

The energy consumption for cleaning the air is therefore determined by the pressure drop across the filter and the air flow through the filter. The energy consumption can become very high if the desired high separation efficiency requires a large pressure drop and the large exhaust air volume to be cleaned requires a large number of air changes.

A conventional method and device for removing fine dust particles is described, for example, in DE 43 00 830 C2. An essential feature is a here that the volume of fresh air is essentially equal to the air volume which is drawn off with the exhaust air and subsequently filtered by a fine filter.

SUMMARY OF THE INVENTION

It is an object of the invention to remove dust particles from areas with a high dust loading using a less complex apparatus and less energy while complying with the regulatory requirements for exhausting a residual dust fraction into the surroundings.

According to an aspect of the invention, the volume of exhaust air is separated into at least two partial flows. With this approach, it is not necessary to reduce the residual dust contents of the entire exhaust air volume exhausted from the area with high dust loading. Instead, the residual dust contents of only one of the partial exhaust air flows exhausted to the surroundings is reduced, while the dust particle fraction of the remaining exhaust air flow is reduced only to a point where it satisfies parameters for re-introduction into the chamber space. This recirculating air flow is subjected to significantly less stringent requirements with respect to the degree of separation than the exhaust air flow which is exhausted into the surroundings.

Accordingly, a device according to the invention produces both a recirculating air flow and an exhaust air flow. For this purpose, compressors or preferably blowers are arranged in the space loaded with dust, which move the partial flows to the separators which separate the airborne particles, such as filters, electrical or cyclone separators.

Moreover, the space loaded with dust particles is preferably provided with control devices which control the power consumption of the compressors or blowers using pressure sensors and/or optical measuring devices.

Advantageously, the energy consumption can be reduced depending on the ratio of the partial flows.

Advantageous embodiments of the method and the device are described in the dependent claims.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

The invention will be described in detail hereinafter with reference to an embodiment. The accompanying drawing shows in.

DETAILED DESCRIPTION OF THE PRESENTLY PREFERRED EMBODIMENTS

Figure 1:
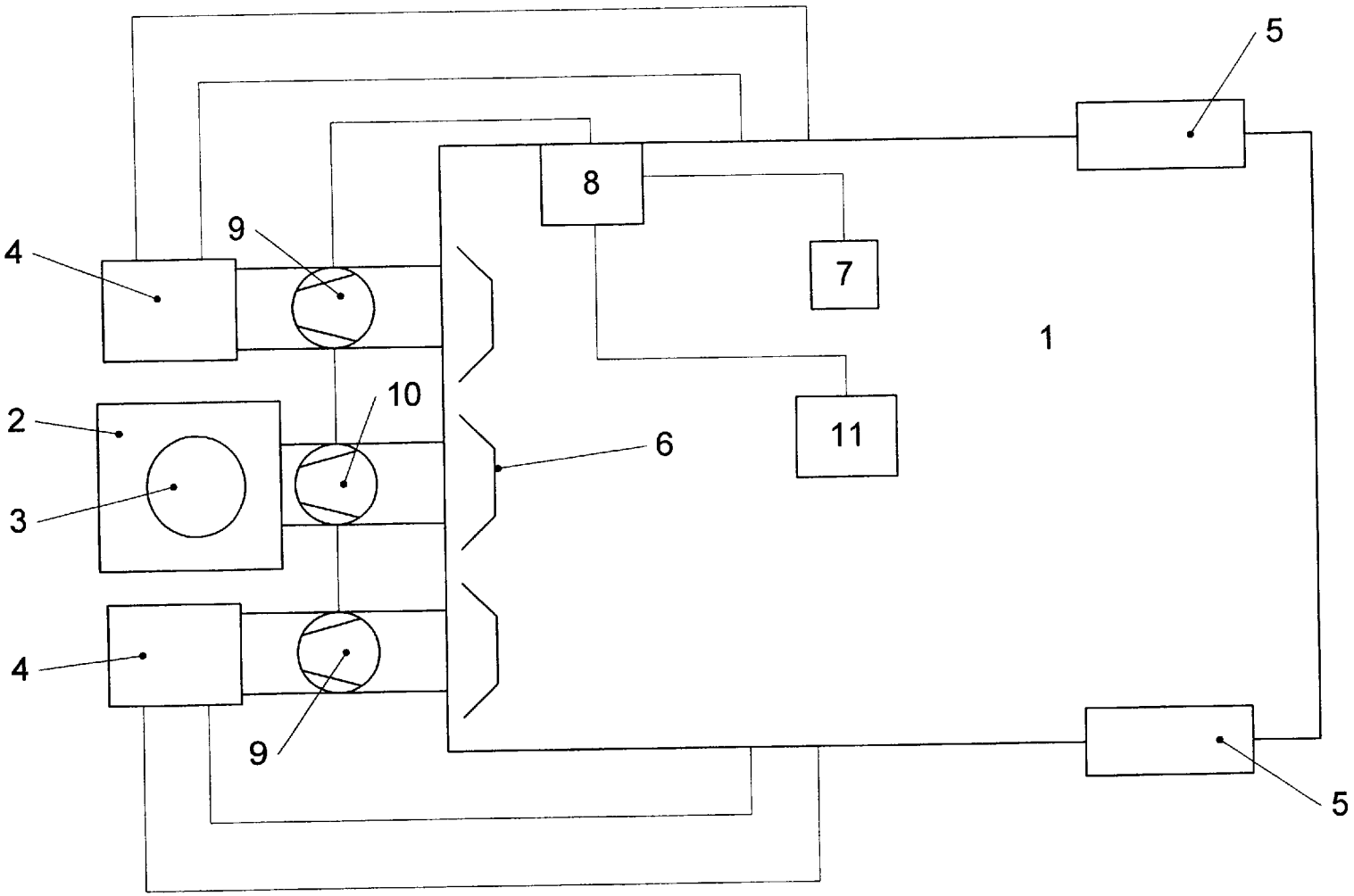
FIG. 1 is a blast jet chamber with recirculating air operation.

In a blast jet chamber 1 approximately 10% of the exhaust air flow are cleaned with a cartridge filter 2 having a high separation efficiency to produce a residual dust fraction of 1 mg/m$^3$ and exhausted into the surroundings through a exhaust stack 3.

The remaining 90% of the large particles in the exhaust air flow, which impair the visibility in the chamber, are separated in a cyclone dust separator having a very small pressure drop. The size of the separated particles is determined mainly by the geometry of the cyclone dust separator 4, by the flow velocity of the recirculating air current and by the density of the particles and the gas, and can be controlled accordingly.

In addition, a predetermined quantity of fresh air which is controlled by fresh air shutters 5, is supplied to the blast jet chamber 1, with intake labyrinths 6 arranged before the intake openings for the exhaust air.

The recirculating portion in the blast jet chamber need not be cleaned to meet the tolerance levels for the residual dust fraction in order to protect the operating personnel of the chamber from health hazards, since regulatory requirements stipulates that personnel working in the space is provided with personal self-contained breathing equipment.

The pressure level in the blast jet chamber 1 is reduced relative to the prevailing atmospheric pressure using the exhaust airflow through the cartridge filter 2 having a high separation efficiency, thereby preventing dust from escaping from the blast jet chamber 1.

The blower 9 which produces the recirculating air flow, operates at constant power and therefore maintains good visibility in the blast jet chamber 1. The blower 10 which produces the exhaust air flow, is operated via a control device 8 in a base load regime, wherein the power is adjusted to the required power level through a frequency converter. In this way, the pressure in the blast jet chamber 1 cannot exceed a pre-described upper value, with this upper value depending on the air-tightness of the blast jet chamber 1. In this way, the pressure in the blast jet chamber 1 is always less than the ambient air pressure. The pressure is measured by the pressure sensor 7.

According to another embodiment for controlling the pressure, the blower 9 is also controlled depending on the visibility in the blast jet chamber 1. For this purpose, an optical measuring device 11 is disposed at a suitable exemplary location in the blast jet chamber 1 and connected to the control device 8.

With the aforedescribed embodiment of a blast jet chamber 1, savings of electrical energy in the order of 50–70% are possible as a result of the lower power consumption of the blowers 9, 10.

In addition, the cartridge filter 2 have a significantly longer service life, thereby reducing maintenance costs. The cyclone dust separators 4 used for the recirculating air flow are robust, wear-resistant and require little maintenance. As a result, the total cost of the facility is significantly reduced.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A method for removing dust from spaces having a high dust loading comprising the steps of (a) dividing the exhaust volume flow into at least two separate partial volume flows;

(b) routing at least one partial volume flow as a closed-loop recirculating volume flow after dust removal;

(c) exhausting at least a second partial volume flow as an exhaust volume flow after dust removal into the surroundings; and (d) removing dust from the recirculating volume flow with a smaller degree of separation according to step (a).

2. The method according to claim 1, wherein the recirculating volume flow is processed so as to remove dust by cyclone separation.

3. A method for removing dust from spaces having a high dust loading comprising the steps of (a) dividing the exhaust volume flow into at least two separate partial volume flows;

(b) routing at least one partial volume flow as a closed-loop recirculating volume flow after dust removal;

(c) exhausting at least a second partial volume flow as an exhaust volume flow after dust removal into the surroundings; and wherein the exhaust volume flow is processed so as to remove dust with a high degree of separation according to step (a).

4. The method according to claim 3, further comprising the step of filtering the exhaust volume flow.

5. A method for removing dust from spaces having a high dust loading comprising the steps of (a) dividing the exhaust volume flow into at least two separate partial volume flows;

(b) routing at least one partial volume flow as a closed-loop recirculating volume flow after dust removal;

(c) exhausting at least a second partial volume flow as an exhaust volume flow after dust removal into the surroundings; and (d) providing a control device for adjusting the required reduced pressure and the visibility in the space loaded with dust.

6. The method according to claim 5, further comprising the step of maintaining the recirculating volume flow constant and controlling the exhaust volume flow as a function of pressure.

7. The method according to claim 5, further comprising the step of controlling the recirculating volume flow depending on visibility in the space loaded with dust.

8. The method according to claim 7, wherein the recirculating volume flow and the exhaust volume flow are controlled.

9. A device for removing dust from spaces having a high dust loading, comprising a last jet chamber (1) including a cartridge filter (2) for the exhaust volume flow, a cyclone dust separator (4) and an associated exhaust stack (3) for processing recirculating volume flow; the blast jet chamber (1) includes an intake labyrinths (6), fresh air shutters (5), recirculating air channels for the recirculating volume flow, and blowers (9, 10) with a control device (8) for producing the volume flows.

10. The device according to claim 9, further comprising at least one pressure sensor (7) connected to the control device (8) for the blowers (9, 10).

11. The device according to claim 9, further comprising at least one optical measuring device (11) connected to the control device (8) for the blowers (9, 10).

12. The device according to claim 9, wherein the blowers (9,10) are controlled by the pressure sensors (7) and the optical measuring devices (11).

* * * * *